US007986889B2

(12) United States Patent
Hamaya

(10) Patent No.: US 7,986,889 B2
(45) Date of Patent: Jul. 26, 2011

(54) ABNORMALITY DETECTION IN AN IMAGE FORMING APPARATUS

(75) Inventor: Masahito Hamaya, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 415 days.

(21) Appl. No.: 12/167,755

(22) Filed: Jul. 3, 2008

(65) Prior Publication Data

US 2009/0010661 A1 Jan. 8, 2009

(30) Foreign Application Priority Data

Jul. 6, 2007 (JP) ..... 2007-178889

(51) Int. Cl.
*G03G 15/02* (2006.01)

(52) U.S. Cl. ..... 399/31

(58) Field of Classification Search ..... 399/31, 399/299, 306, 302, 308
See application file for complete search history.

(56) References Cited

U.S. PATENT DOCUMENTS

| | | | | |
|---|---|---|---|---|
| 5,778,291 | A * | 7/1998 | Okubo et al. | 399/302 |
| 2007/0147858 | A1 * | 6/2007 | Inukai | 399/31 |
| 2008/0085131 | A1 | 4/2008 | Kitazawa et al. | |

FOREIGN PATENT DOCUMENTS

| | | |
|---|---|---|
| JP | 09-190870 | 7/1997 |
| JP | 2000-112302 | 4/2000 |
| JP | 2002-236435 | 8/2002 |
| JP | 2003-316128 | 11/2003 |
| JP | 2003-330251 | 11/2003 |
| JP | 2004-357460 | 12/2004 |
| JP | 2007-178595 | 7/2007 |
| JP | 2008-096534 | 4/2008 |

OTHER PUBLICATIONS

Notification of Reasons for Refusal for Japanese Patent Application No. 2007-178889 mailed Jun. 9, 2009.

* cited by examiner

*Primary Examiner* — Quana M Grainger
(74) *Attorney, Agent, or Firm* — Banner & Witcoff, Ltd.

(57) ABSTRACT

An image forming apparatus includes: a plurality of photosensitive members; a plurality of discharging units respectively facing the plurality of photosensitive members; a plurality of high-voltage power supply units which are provided for the plurality of charging units and supply power to the plurality of discharging units; a discharge detection unit that detects abnormality in the plurality of discharging units; a controller which controls the output of one of the high-voltage power supply units having the largest output to be smaller when the discharge detection unit detects abnormality; and a determination unit which, in a state where the controller controls the output of the one of the high-voltage power supply unit, determines whether abnormality occurs in the discharging unit corresponding to the one of the high-voltage power supply unit based on the detection state of the discharge detection unit.

16 Claims, 8 Drawing Sheets

ABNORMALITY DETECTION IN AN IMAGE FORMING APPARATUS

CROSS-REFERENCE TO RELATED APPLICATION

This application claims priority from Japanese Patent Application No. 2007-178889, filed on Jul. 6, 2007, the entire subject matter of which is incorporated herein by reference.

TECHNICAL FIELD

Aspects of the present invention relate to an image forming apparatus that detects occurrence of abnormality in a charging unit or a static eliminating unit.

BACKGROUND

JP-A-2000-112302 and JP-A-2003-316128 describe an image forming apparatus that detects abnormality in a charger.

An image forming apparatus described in JP-A-2000-112302 includes a single photosensitive member that is charged at the time of image forming and transfers a toner image onto a sheet. In the image forming apparatus, a charger leak detection circuit is provided on an output side of a high-voltage power supply unit connected to a primary charger, which charges the photosensitive member uniformly at a predetermined potential. The charger leak detection circuit detects occurrence of leak. In addition, in the image forming apparatus, a static eliminator leak detection circuit is provided on an output side of a high-voltage power supply unit connected to a static eliminator, which eliminates a transfer charge on the rear surface of the sheet to thereby separate the sheet attached to the photosensitive member from the photosensitive member. The static eliminator leak detection circuit detects occurrence of leak.

An image forming apparatus described in JP-2003-316128 includes four high-voltage power supply units and four chargers provided to correspond to photosensitive members of four colors. Each high-voltage power supply unit includes a leak detection circuit that detects leak of charging bias.

However, since a leak detection circuit is provided for each charger to detect abnormality in the above-described image forming apparatus, the circuit configuration is complicated and expensive.

JP-A-2007-178598 filed by the assignee of this application describes an image forming apparatus including a single discharge detection unit connected to a plurality of charging units or static eliminating units in parallel. In this image forming apparatus, the single discharge detection unit detects abnormality in the plurality of charging units or static eliminating units. With this image forming apparatus, the number of discharge detection units can be reduced, and thus the circuit configuration can be simplified and costs can be reduced.

However, in the image forming apparatus, since the discharge detection unit is connected to the plurality of charging units or static eliminating units in parallel, even if the discharge detection unit detects abnormality, the discharge diction unit could not specify a charging unit or static eliminating unit in which abnormality occurs. Accordingly, in this image forming apparatus, high-voltage power supply units are controlled so as to apply high voltage to the charging units or static eliminating units at different timings, and presence/absence of abnormality is detected for all of the charging units or static eliminating units, thereby detecting a charging unit or static eliminating unit, in which abnormality occurs. For this reason, in this image forming apparatus, it takes much time to detect abnormality in the charging unit or static eliminating unit.

To obtain a satisfactory printing result, each time a high-voltage power supply unit applies a voltage to a charging unit or static eliminating unit, the image forming apparatus checks whether or not abnormality occurs in the charging unit or static eliminating unit. Similarly to the above-described image forming apparatus, if it takes much time to detect abnormality in the charging unit or static eliminating unit, a print time may become longer, and a user may feel inconvenience. For this reason, there is a need for an image forming apparatus that can detect abnormality in a charging unit or static eliminating unit in a short time.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus that can detect a charging unit or static eliminating unit, in which abnormality occurs, among a plurality of charging or static eliminating units in a short time.

According to an aspect of the present invention, there is provided an image forming apparatus including: a plurality of photosensitive members; a plurality of discharging units respectively facing the plurality of photosensitive members; a plurality of high-voltage power supply units which are provided for the plurality of charging units and supply power to the plurality of discharging units; a discharge detection unit that detects abnormality in the plurality of discharging units; a controller which controls the output of one of the high-voltage power supply units having the largest output to be smaller when the discharge detection unit detects abnormality; and a determination unit which, in a state where the controller controls the output of the one of the high-voltage power supply unit, determines whether abnormality occurs in the discharging unit corresponding to the one of the high-voltage power supply unit based on the detection state of the discharge detection unit.

According to another aspect of the present invention, there is provided an abnormal discharge detection device including: a plurality of discharging units; a plurality of power supply units which apply voltage to the plurality of discharging units; a discharge detection unit which detects abnormality occurring in any one of the plurality of discharging units; a voltage detection unit which detects application voltages of the plurality of power supply units; a controller configured to control the application voltages of the plurality of power supply units; a determination unit which determines in which one of the discharging units the abnormality occurs in the order of the values of the detected application voltages by controlling the application voltage of the plurality power supply units in the order.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Exemplary embodiments of an image forming apparatus according to the present invention will now be described with reference to the drawings.

First Exemplary Embodiment

Figure 1:
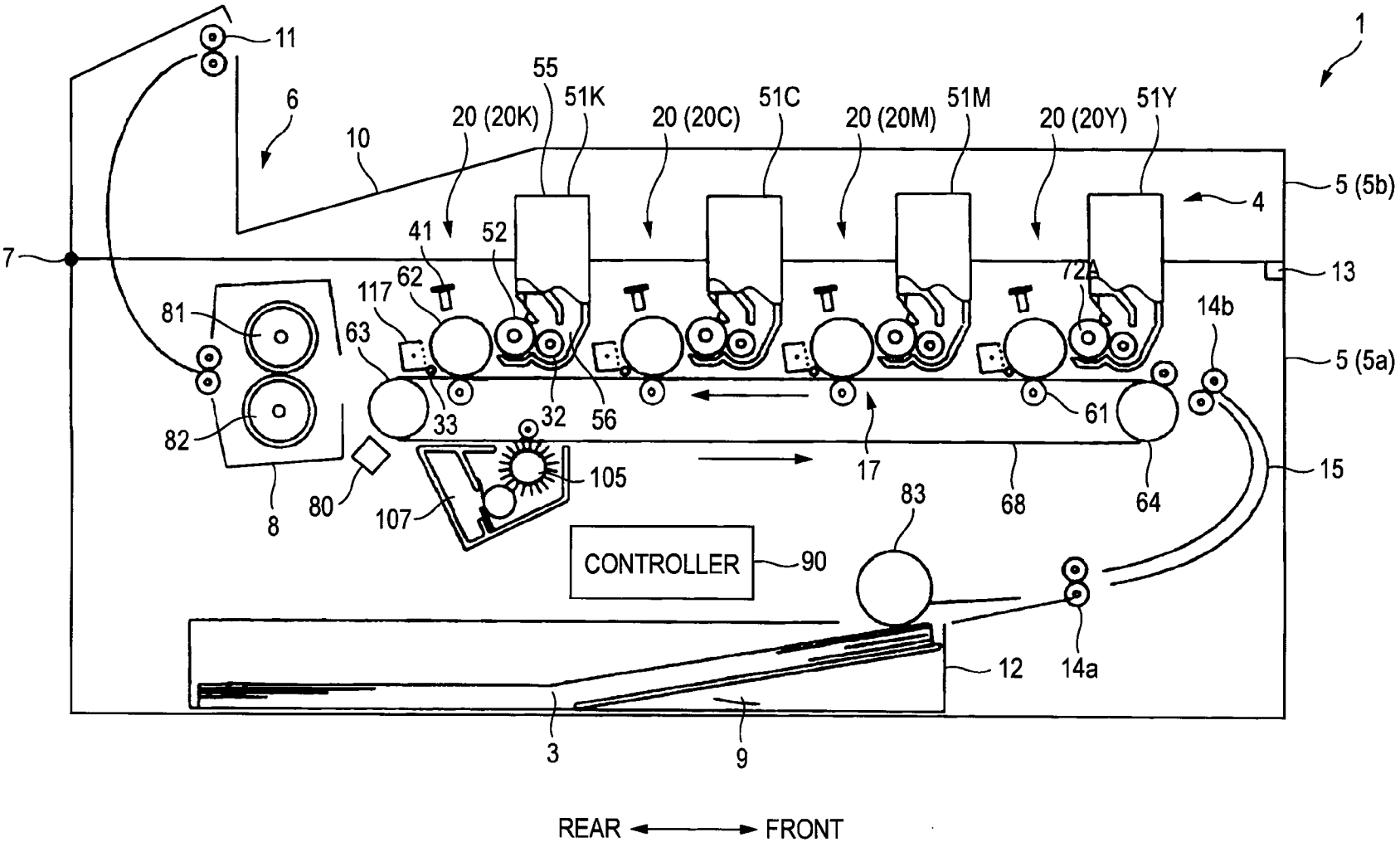
FIG. 1 is an explanatory view illustrating the schematic configuration of a color electrophotographic printer according to a first exemplary embodiment of the present invention.

FIG. 1 is a cross-sectional view illustrating the schematic configuration of a color electrophotographic printer 1 according to a first exemplary embodiment of the present invention.

In a printer 1 as an example of an image forming apparatus according to the first exemplary embodiment, when a single discharge detection circuit 130 detects abnormality in a plurality of chargers 117 as an example of a discharging unit, in a state where the output of a high-voltage power supply unit 110 having the largest output is controlled to be smaller than the current value (output) thereof, it is determined, on the basis of the detection state of the discharge detection circuit 130, whether or not abnormality occurs in a charger 117.

Herein, the term "output" is a concept including power (for example, supply current or output voltage) which is supplied from the high-voltage power supply unit 110 to the charger 117, and control information (PWM control signal) for controlling output power of the high-voltage power supply unit 110. Even if the output of the high-voltage power supply unit 110 has the same voltage value, absolute signs in the plus power source and a minus power source. Accordingly, when the "output" represents an "output voltage", the absolute value of the output voltage should be assumed as the "output". In this exemplary embodiment, it is assumed that the output of the high-voltage power supply unit 110 is constituted from a plus power source.

<Configuration of Color Electrophotographic Printer>

In FIG. 1, the printer 1 is a transverse arrangement type tandem color electrophotographic printer in which four image forming units 20 are arranged in a horizontal direction. The printer 1 includes, in a main body casing 5, a sheet feed section 9 that feeds a recording sheet 3 as a recording medium, an image forming section 4 that forms an image on the fed recording sheet 3, a sheet discharge section 6 that discharges the recording sheet 3 on which the image has been formed, and a controller 90 that controls the operation of the printer 1.

The main body casing 5 includes a main body portion 5*a* having an opened upper surface and a cover 5*b* pivotably held by the main body portion 5*a* through a hinge 7 so as to cover the opening of the main body 5*a*. To the inner wall of the main body portion 5*a*, an open/close sensor 13 is attached to detect an open/close state of the cover 5*b*. The sheet feed section 9 includes, at the bottom in the main body portion 5*a*, a sheet feeding tray 12 that is removably mounted in the main body casing 5 from the front side (right side in FIG. 1), a feed roller 83 that is provided above the front end of the sheet feeding tray 12, and convey rollers 14*a* and 14*b* that are provided on the downstream in a convey direction of the recording sheet 3 from the feed roller 83 to be more front side than the feed roller 83 (hereinafter, the downstream side in the convey direction of the recording sheet 3 may be simply referred to as "downstream side", and the upstream side in the convey direction of the recording sheet 3 may be simply referred to as "upstream side").

In the sheet feeding tray 12, the recording sheets 3 are stacked, and a topmost recording sheet 3 of the stacked recording sheets 3 is fed by rotation of the feed roller 83 toward the convey rollers 14*a* and 14*b* one by one and sequentially conveyed between a convey belt 68 and each photosensitive member 62 (transfer position).

Between the convey roller 14*a* and the convey roller 14*b*, a guide member 15 is provided to extend in an up-and-down direction. The recording sheet 3 fed by the feed roller 83 is sequentially conveyed between the convey belt 68 and the photosensitive member 62 (transfer position) by the convey roller 14*a*, the guide member 15, and the convey roller 14*b*.

The image forming section 4 includes, in an intermediate portion in the main body casing 5, four image forming units 20Y, 20M, 20C, and 20K that form images, a transfer unit 17 that transfers the image formed in each image forming unit 20 onto the recording sheet 3, and a fixing unit 8 that applies heat and pressure to the image transferred onto the recording sheet 3 to thereby fix the image to the recording sheet 3. The appended characters Y, M, C, and K represent colors of yellow (Y), magenta (M), cyan (C), and black (K), respectively. In case that it is not necessary to distinguish the colors from each other, the appended characters are omitted.

Each of the image forming units 20 includes a photosensitive member 62 serving as an image bearing member. Each image forming unit 20 includes, around the photosensitive member 62, a static eliminator 33 which separates the recording sheet 3 attached to the photosensitive member 62 from the photosensitive member 62, a charger 117 which charges the photosensitive member 62, an exposure unit 41 which forms an electrostatic latent image on the photosensitive member 62, and a developing unit 51 which attaches toner as a developer onto the photosensitive member 62 by a development bias applied between the photosensitive member 62 and the developing unit 51 to form a toner image.

The static eliminator 33 is connected to a high-voltage power supply unit 110 described below. The static eliminator 33 is configured, for example, to generate AC corona discharge, which is biased with an opposite polarity to a polarity at the time of transfer by a static eliminating wire made of a tungsten wire, to thereby eliminate a transfer bias on the rear surface of the recording sheet 3. The charger 117 is connected to the high-voltage power supply unit 110 described below. The charger 117 is, for example, a scorotron type charger for positive charge that generates corona discharge by a charging wire made of a tungsten wire to thereby charge the surface of the photosensitive member 62 uniformly with positive polarity. The exposure unit 41 includes a LED array that generates light for forming an electrostatic latent image on the surface of the photosensitive member 62.

In the exposure unit 41, light emitted from the LED array is irradiated onto the photosensitive member 62, and then the electrostatic latent image is formed on the surface of the photosensitive member 62. The exposure unit 41 is not necessarily the LED array, and may be, for example, an exposure scan unit (laser scanner) that scans a laser beam to expose the photosensitive member 62 to light.

The developing unit 51 includes, in a developing casing 55, a hopper 56, a supply roller 32, and a developing roller 52. The hopper 56 is formed as an inner space of the developing casing 55. In the hopper 56, toner (for example, positively chargeable, non-magnetic one component polymerized toner) of each of the colors of yellow (Y), magenta (M), cyan (C), and black (K) is stored for respective one of the image forming units 20.

That is, the four image forming units 20 include the image forming unit 20Y in which yellow (Y) toner is stored in the hopper 56Y, the image forming unit 20M in which magenta (M) toner is stored in the hopper 56M, the image forming unit 20C in which cyan (C) toner is stored in the hopper 56C, and the image forming unit 20K in which black (K) toner is stored in the hopper 56K. The image forming units are different in only color of toner but have the same configuration (in FIG. 1, some of reference numbers are omitted).

The supply roller 32 is arranged on the lower side of the hopper 56 and includes a metallic roller shaft and a roller portion made of a conductive sponge member surrounding the roller shaft. The supply roller 32 is rotatably supported such that the supply roller 32 comes into contact with the developing roller 52 at a nip portion and rotates in an opposite direction to the rotation direction of the developing roller 52.

The developing roller 52 is rotatably disposed to face and contact with the supply roller 32. The developing roller 52 includes a metallic roller shaft and a roller portion which is made of an elastic member such as a conductive rubber material and covers the roller shaft. A predetermined development bias voltage is applied from a power supply 85 (see FIG. 2) to the developing roller 32, as described below.

The transfer unit 17 is provided in the main body casing 5 so as to face the photosensitive member 62. The transfer unit 17 includes a convey belt driving roller 63, a convey belt driven roller 64, an endless convey belt 68, and a transfer roller 61.

The convey belt driven roller 64 is arranged on the upstream side (forward side) from the photosensitive member 62 of the yellow image forming unit 20Y, which is located on the most upstream side in the convey direction of the recording sheet 3. The driven roller 64 is arranged on the forward side of the feed roller 83. Further, the convey belt driving roller 63 is arranged on the downstream side (backward side) from the photosensitive member 62 of the black image forming unit 20K, which is located on the most downstream side in the convey direction of the recording sheet 3. The convey belt driving roller 63 is arranged on the upstream side (forward side) from the fixing unit 8.

The convey belt 68 is wound around the convey belt driving roller 63 and the convey belt driven roller 64. The convey belt 68 is arranged such that its outer surface comes into contact with all of the photosensitive members 62 of the respective image forming units 20.

By driving the convey belt driving roller 63, the convey belt driven roller 64 is driven, and the convey belt 68 moves around the convey belt driving roller 63 and the convey belt driven roller 64 counterclockwise. That is, the convey belt 68 moves such that the contact surface thereof which comes into contact with each photosensitive member 62 of each image forming unit 20 moves in the same direction as the rotating direction of the photosensitive member 62.

The transfer roller 61 is arranged inside of the convey belt 68 wound around the rollers 63 and 64 to face the photosensitive member 62 of each image forming unit 20 with the convey belt 68 interposed therebetween. The transfer roller 61 includes a metallic roller shaft and a roller portion which is made of an elastic member such as a conductive rubber material and covers the roller shaft.

The transfer roller 61 is provided rotatably counterclockwise so as to rotate in the same direction as the moving direction of the convey belt 68 at a contact surface with the convey belt 68. At the time of transfer, a predetermined voltage is applied from a power supply (not shown) between the transfer roller 61 and the photosensitive member 62 in a direction where the toner image born on the photosensitive member 62 is shifted (transferred) to the recording sheet 3, and an appropriate transfer bias is applied by constant-current control.

The fixing unit 8 is arranged on the downstream side (rear side) of the image forming unit 20 and the transfer unit 17. The fixing unit 8 includes a heating roller 81 and a pressing roller 82. The heating roller 81 has a metallic pipe on a surface of which a release layer is formed. The heating roller 81 includes a halogen lamp which extends in its axial direction. The surface of the heating roller 81 is heated by the halogen lamp at a fixing temperature. In addition, the pressing roller 82 is arranged so as to press the heating roller 81.

The sheet discharge section 6 is arranged, at the upper portion of the main body casing 5, on the downstream side of the fixing unit 8. The sheet discharge section 6 includes a pair of discharge rollers 11 that discharges the recording sheet 3, on which image fixing is completed, to the sheet discharging tray 10, and the sheet discharging tray 10 that is arranged on the downstream side of the discharge rollers 11 and stacks thereon the recording sheet 3 which has completed all image forming steps.

Diagonally to the lower rear side of the convey belt driving roller 63, a density sensor 80 for reading a patch formed on the convey belt 68 is provided to face the outer surface of the convey belt 68. Diagonally to the lower front side of the convey belt driving roller 63, a toner collector 107 for collecting toner (the patch) attached on the convey belt 68 is arranged such that a toner collecting roller 105 of the toner collector 107 comes into contact with the outer surface of the convey belt 68.

<Electrical Configuration of Color Electrophotographic Printer>

Figure 2:
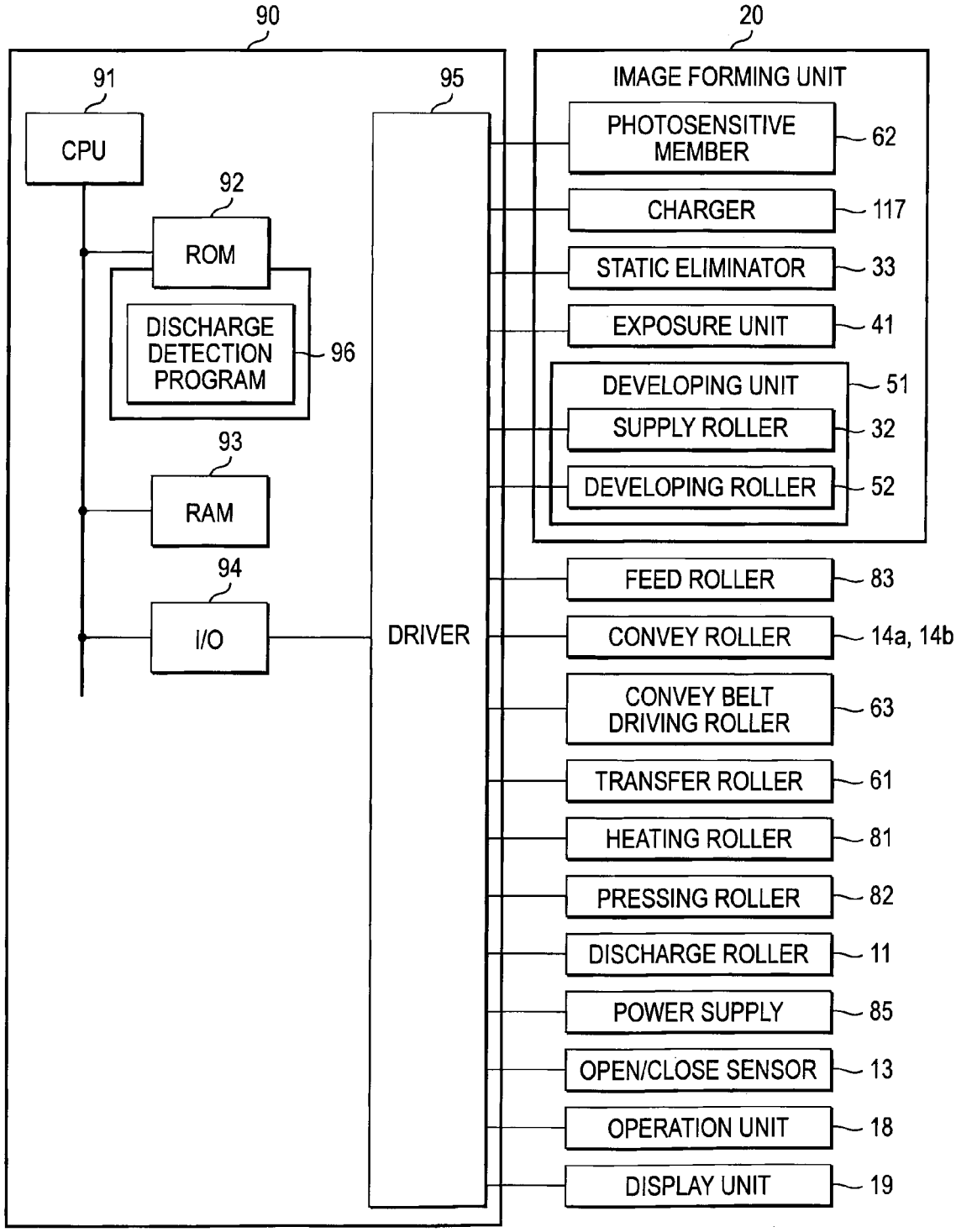
FIG. 2 is a block diagram schematically illustrating the electrical configuration of the color electrophotographic printer shown in FIG. 1.

Referring to FIG. 2, together with the electrical configuration of the printer 1, a process until the printer 1 forms a color image on the recording sheet 3 will be described. FIG. 2 is a block diagram schematically illustrating the electrical configuration of the printer 1.

As shown in FIG. 2, the printer 1 includes a controller 90 that performs overall control of the individual components in the apparatus. The controller 90 includes a CPU 91, a ROM 92, a RAM 93, an I/O 94, a driver 95, and the like. The ROM 92 stores a discharge detection program 96 described below.

Connected to the controller 90 are the photosensitive member 62, the charger 117, the static eliminator 33, the exposure unit 41, and the supply roller 32 and the developing roller 52 of the developing unit 51, which are provided in the image forming unit 20. In addition, connected to the controller 90 are the feed roller 83, the convey rollers 14*a* and 14*b*, the convey belt driving roller 63, the transfer roller 61, the heating roller 81, the pressing roller 82, the discharge rollers 11, the power supply 85, the open/close sensor 13, an operation unit 18, and a display unit 19.

When the power supply 85 is switched on, a main control processing section (program) starts and the controller 90 of the printer 1 enters a standby state. The controller 90, upon input of an image forming instruction, performs initial setting of each apparatus component to be controlled by the main control processing section (program). Thereafter, the controller 90 charges uniformly the surface of the photosensitive member 62 by the charger 117, and irradiates light from the exposure unit 41 to the photosensitive member 62 according to image information, to thereby form an electrostatic latent image on the surface of the photosensitive member 62. Next, toner is attached on the surface of the photosensitive member 62 by the developing unit 51, and the electrostatic latent image on the surface of the photosensitive member 62 is developed. Next, with rotation of the photosensitive member 62, the developed toner image is moved to the transfer position.

The controller 90 controls the feed roller 83 and the convey rollers 14*a* and 14*b* to thereby feed the recording sheet 3 to the convey belt 68. Next, the controller 90 drives the convey belt driving roller 63 and circularly moves the convey belt 68 to thereby feed the recording sheet 3 to the transfer position. At the transfer position, the transfer bias is applied between the transfer roller 61 and the photosensitive member 62, such that the toner image is transferred onto the recording sheet 3.

Next, the controller 90 circularly moves the convey belt 68 and conveys the recording sheet 3 to the fixing unit 8. At this time, the controller 90 eliminates the transfer bias from the recording sheet 3 by the static eliminator 33, such that the recording sheet 3 can be easily separated from the photosensitive member 62 and smoothly conveyed to the fixing unit 8. In the fixing unit 8, the recording sheet 3 is conveyed while being pinched between the heating roller 81 and the pressing roller 82, and heat and pressure is applied to the toner image on the recording sheet 3, to thereby fix the toner image on the recording sheet 3. Next, the controller 90 controls the discharge rollers 11, such that the recording sheet 3 is discharged to the sheet discharging tray 10 located at the upper portion of the main body casing 5, and the image forming operation ends.

<Discharge Detection Circuit>

Figure 3:
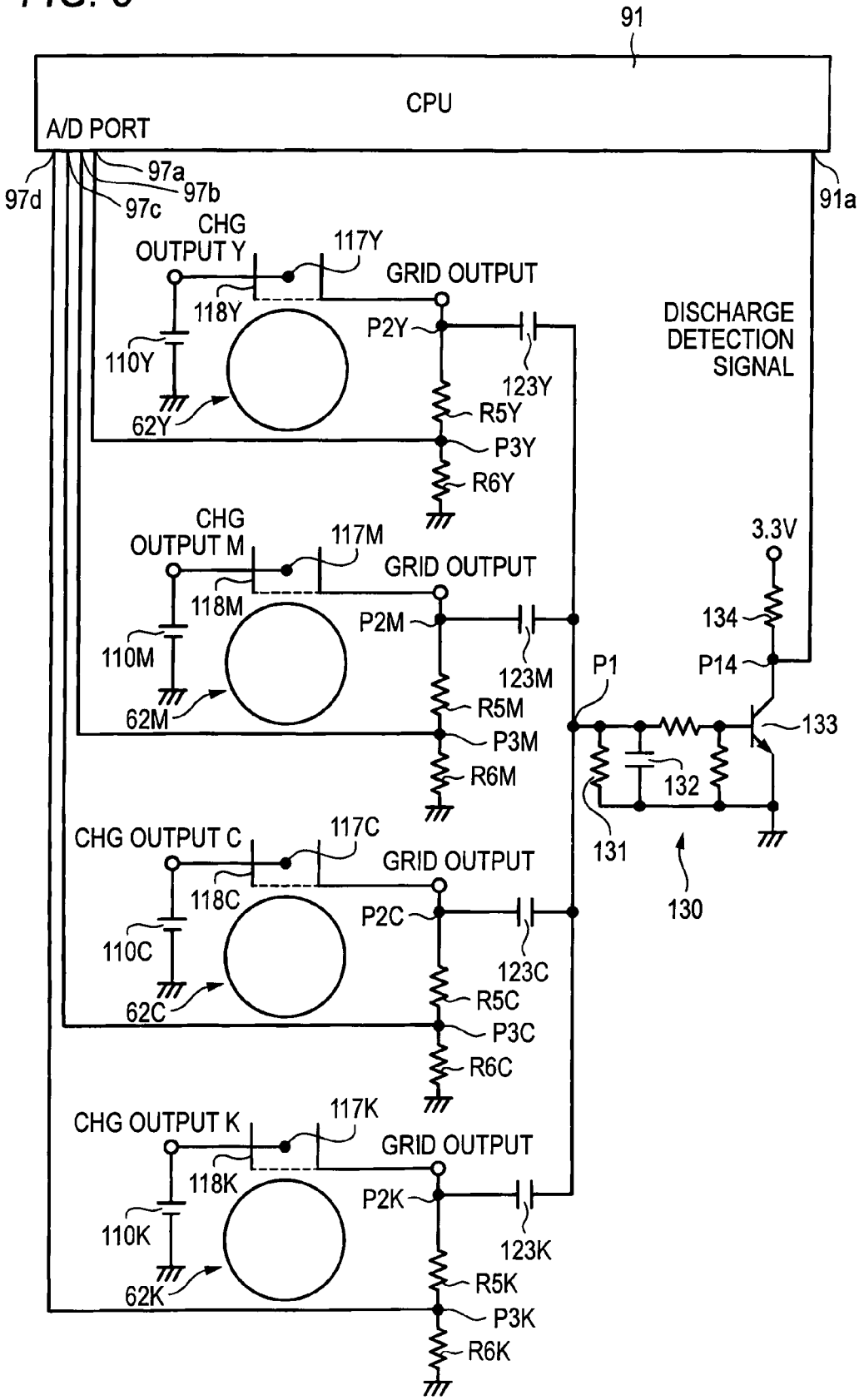
FIG. 3 is a diagram illustrating a discharge detection circuit that is used in the color electrophotographic printer shown in FIG. 1.

FIG. 3 is a diagram a discharge detection circuit 130 that is used in the printer 1 shown in FIG. 1. To the discharge detection circuit 130, a first charger 117Y, a second charger 117M, a third charger 117C and a fourth charger 117K are connected in parallel. The discharge detection circuit 130 detects arc discharge that occurs locally when the first to fourth chargers 117Y, 117M, 117C, and 117K charge the first to fourth photosensitive members 62Y, 62M, 62C, and 62K, respectively, to thereby detect abnormality in the first to fourth chargers 117Y, 117M, 117C, and 117K.

The charger 117 is arranged to face the photosensitive member 62 one-to-one and applies a high charge voltage generated by the high-voltage power supply unit 110 to the photosensitive member 62, to thereby charge the photosensitive member 62. The configuration of the high-voltage power supply unit 110 will be described below. A current supplied to the charger 117 is corona-discharged between the charger 117, and a GRID portion 118 and the photosensitive member 62, to thereby charge the photosensitive member 62. Accordingly, the potential of the photosensitive member 62 is determined by the potential of the GRID portion 118.

The GRID portion 118 outputs a current toward a connection point P2 by a voltage generated at the time of discharge. To the connection point P2, a resistor R5 and a capacitor 123 are connected in parallel. The capacitor 123 causes a sharply increasing current, which is generated when the arc discharge is generated between a charging wire constituting the charger 117 and the GRID portion 118, flow from the connection point P2 to the discharge detection circuit 130 through a connection point P1. In this exemplary embodiment, the capacitor 123 functions to cut a DC component in the voltage of the connection point P2 and causes only an AC component flow to the connection point P1. To the resistor R5, a resistor R6 is connected in series through a connection point P3.

The CPU 91 includes a first A/D port 97*a*, a second A/D port 97*b*, a third A/D port 97*c*, and a fourth A/D port 97*d*. To the first to fourth A/D ports 97*a*, 97*b*, 97*c*, and 97*d*, connection points P3Y, P3M, P3C, and P3K of the individual first to fourth chargers 117Y, 117M, 117C, and 117K are connected, respectively. In case that it is not necessary to distinguish the first to fourth A/D ports 97*a*, 97*b*, 97*c*, and 97*d* from each other, an "A/D port 97" is used in the description and the drawings.

The discharge detection circuit 130 includes a resistor 131, a capacitor 132, a transistor 133, and a resistor 134. The resistor 131 and the capacitor 132 are provided in order to adjust the voltage applied to the connection point P1. That is, the resistor 131 adjusts the voltage applied to the connection point P1, and the capacitor 132 decreases a peak value of the voltage applied to the connection point P1, such that an output signal to be output to the transistor 133 is taken out. Accordingly, even though the voltage supplied to the connection point P1 includes noise, since the transistor 133 reacts with only the output signal that applies a large voltage, which is equal to or more than a predetermined voltage, to the connection point P1, the discharge detection circuit 130 can eliminate the influence of noise on discharge detection.

In the transistor 133, an emitter is connected to the ground, a collector is connected to a power supply through the resistor 134, and a base is connected to the connection point P1. A connection point P4 is provided between the transistor 133 and the resistor 134, and connected to a discharge detection signal input port 91*a* provided in the CPU 91. The resistor 134 is provided in order to pull-up the voltage of the connection point P4.

The CPU 91 detects presence/absence of abnormal discharge on the basis of the voltage (discharge detection signal) applied from the connection point P4 to the discharge detection signal input port 91*a*. When no current flows between the collector and the emitter of the transistor 133, and the voltage of the connection point P4 is made approximately 3.3 V, the CPU 91 determines that the discharge detection signal input port 91*a* is put in a high state (hereinafter, referred to as "H") and normal discharge, that is, corona discharge is performed. Meanwhile, when a current flows between the collector and the emitter of the transistor 133, and the voltage of the connection point P4 becomes low and is 0 V or in a state close to 0 V, the CPU 91 determines that the discharge detection signal input port 91*a* is put in a low state (hereinafter, referred to as "L") and abnormal discharge, that is, arc discharge occurs locally in the charging wire constituting the charger 117.

<High-Voltage Power Supply Unit>

Figure 4:
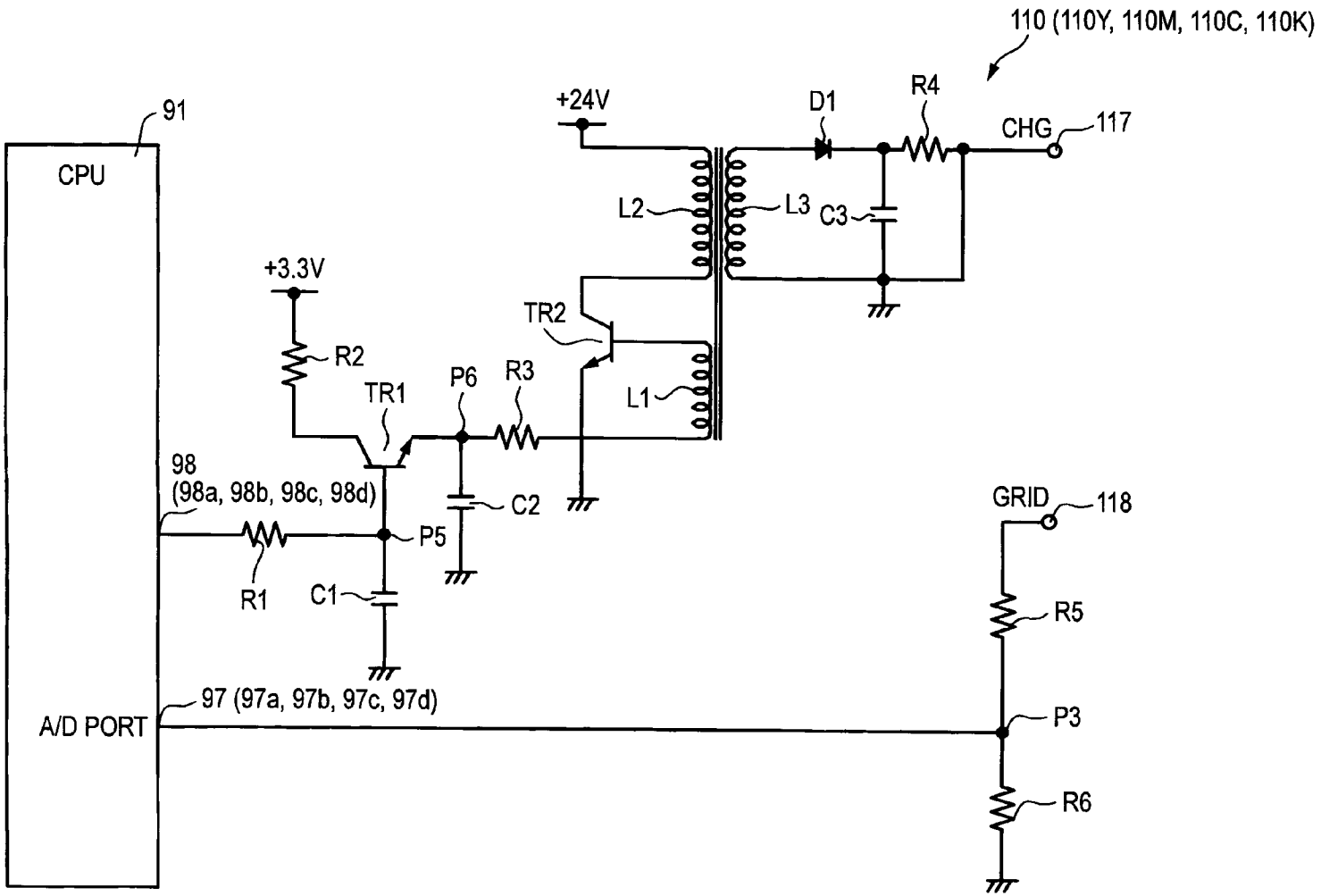
FIG. 4 is a block diagram of a high-voltage power supply unit shown in FIG. 3.

FIG. 4 is a block diagram of the high-voltage power supply unit 110 shown in FIG. 3. The high-voltage power supply units 110Y, 110M, 110C, and 110K are provided to correspond to the chargers 110Y, 110M, 110C, and 110K. Since the high-voltage power supply units 110Y, 110M, 110C, and 110K have the same configuration, only one high-voltage power supply unit 110 is shown in FIG. 4.

The high-voltage power supply unit 110 applies a high voltage to the corresponding charger 117. The CPU 91 has a control information output port 98 (98*a*, 98*b*, 98*c*, and 98*d*), which outputs a PWM control signal, by the number of chargers 117. The high-voltage power supply unit 110 controls the voltage applied to the charger 117 according to the PWM control signal which is output from the control information output port 98.

In the high-voltage power supply unit 110, the control information output port 98 of the CPU 91 is connected to a base of a transistor TR1 through a resistor R1. A connection point P5 between the resistor R1 and the transistor TR1 is connected to the ground through a capacitor C1. The resistor R1 is provided in order to adjust the voltage applied from the control information output port 98 to the connection point P5, and the capacitor C1 is provided in order to smooth a voltage acting on the base of the transistor TR1.

In the transistor TR1, a collector is connected to the power supply through a resistor R2, an emitter is connected to a resistor R3, and the base is connected to the control information output port 98 of the CPU 91 through the connection point P5, as described above. A connection point P6 provided between the transistor TR1 and the resistor R3 is connected to the ground through a capacitor C2. The resistor R3 is connected to a base of transistor TR2 through a coil L1.

For example, when no voltage is applied to the base of the transistor TR1 from the CPU 91, no current flows between the collector and the emitter of the transistor TR1. In this case, no voltage is applied to the base of the transistor TR2, and no current flows between the collector and the emitter of the transistor TR2. Meanwhile, if a voltage is applied to the base of the transistor TR1 from the CPU 91, a current flows between the collector and the emitter of the transistor TR1. Accordingly, a voltage is applied to the base of the transistor TR2, and a current flows between the collector and the emitter of the transistor TR2. The voltage output from the transistor TR1 is smoothed by the capacitor C2 and the resistor R3.

Accordingly, the transistor TR2 is switched between a conductive state and a non-conductive state in synchronization with the transistor TR1. The collector of the transistor TR2 is connected to a primary coil L2 of a transformer. When a current flows between the collector and the emitter of the transistor TR2, the transformer increases a voltage (for example, 24 V) applied to the primary coil L2 from the power supply to, for example, 6000 to 8000 V between the primary coil L2 and a secondary coil L3. Therefore, the transformer outputs high-voltage AC power according to the switching operation of the transistor TR2 between the conductive state and the non-conductive state.

The secondary coil L3 of the transformer is connected to the charger 117 through a diode D1 and a resistor R4. AC power output from the secondary coil L3 is adjusted in the diode D1, then converted into a smooth DC current by a capacitor C3, and subsequently supplied to the charger 117. The resistor R4 is a short-circuit protection resistor. As a result, a constant current is supplied to the charger 117. In this exemplary embodiment, a current of 300 μA is supplied to the charger 117.

By applying a high voltage (for example, 6000 to 8000 V) to the scorotron type charger 117, corona discharge is generated in the wire. With corona discharge, multiple ions are generated around the wire, and the ions are discharged to the photosensitive member 62 (see FIG. 3) and the GRID portion 118, such that a current flows in the GRID portion 118. For example, if the charger 117 performs normal discharge, a current of 275 μA flows in the GRID portion 118. To the GRID portion 118, resistors R5 and R6 are connected, and a voltage is generated at the connection point P3 provided between the resistors R5 and R6. The connection point P3 is connected to the A/D port 97 (97*a*, 97*b*, 97*c*, and 97*d*) of the CPU 91.

The CPU 91 outputs the PWM control signal from the control information output port 98 (98*a*, 98*b*, 98*c*, and 98*d*) to make the charge voltage generated by the charger 117 stable, such that the voltage input to the A/D port 97 (97*a*, 97*b*, 97*c*, and 97*d*) is controlled to be constant, that is, the amount of the current from the GRID portion 118 is controlled to be constant (in other words, the voltage of the GRID portion 118 is controlled to be constant).

For example, when the amount of the current from the GRID portion 118 is small, that is, the voltage of the GRID portion 118 is low, the CPU 91 determines that the charge voltage is low, and increases the duty value of the PWM control signal, to thereby increase the application voltage of the high-voltage power supply unit 110. Meanwhile, when the amount of the current from the GRID portion 118 is large, that is, the voltage of the GRID portion 118 is high, the CPU 91 determines that the charge voltage is high, and decreases the duty value of the PWM control signal, to thereby decrease the application voltage of the high-voltage power supply unit 110. Ideally, the application voltage of the high-voltage power supply unit 110 to the charger 117 is proportional to the duty value of the PWM control signal output from the control information output port 98 (98*a*, 98*b*, 98*c*, and 98*d*). Accordingly, by calculating the duty value of the PWM control signal, the application voltage of the high-voltage power supply unit 110 can be detected.

<Operation of Discharge Detection Program>

Figure 5:
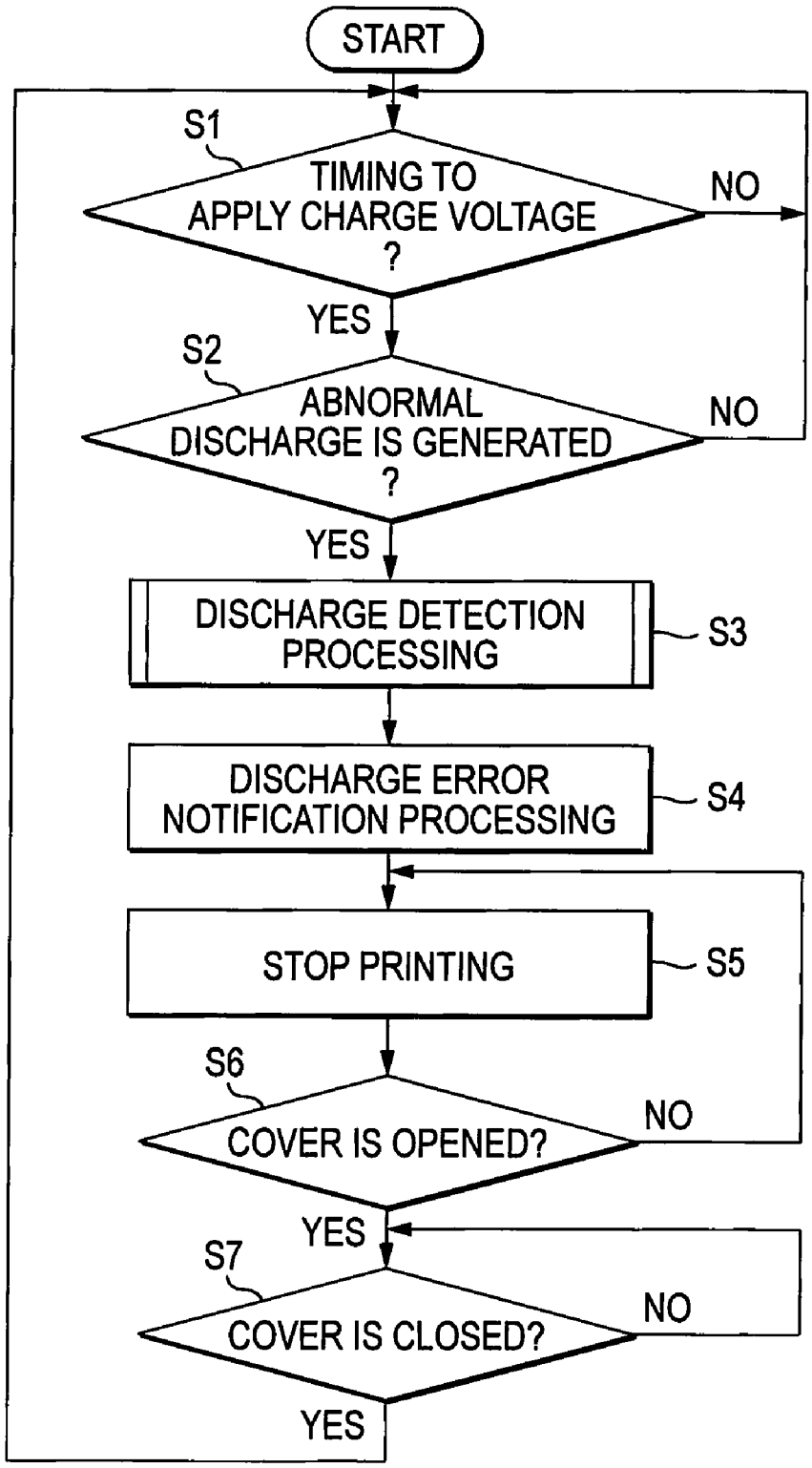
FIG. 5 is a diagram illustrating a processing procedure of a discharge detection program that is executed by a CPU shown in FIG. 3.

Next, the operation of the discharge detection program 96 will be described. FIG. 5 is a diagram illustrating a processing procedure of a discharge detection program 96 that is executed by the CPU 91 shown in FIG. 3.

The CPU 91 switches on the printer 1 to start the main control processing section (program), reads the discharge detection program 96 from the ROM 92 and copies the discharge detection program 96 to the RAM 93, and executes the discharge detection program 96 at a predetermined time interval.

As described above, the application voltage of the high-voltage power supply unit 110 is made stable by controlling the amount of the current from the GRID portion 118 (the voltage of the GRID portion 118) to be constant. Ideally, it is considered that, if the charger 117 generates arc discharge in the GRID portion 118, and the amount of the current from the GRID portion 118, that is, the voltage of the GRID portion 118 is increased, the charger 117 which generates the arc discharge may be specified from the A/D port 97 to which the voltage is input.

However, since the arc discharge is actually generated instantaneously, it is difficult to detect a change in the voltage of the connection point P3, and to specify the charger 117 which generates the arc discharge. In addition, when the voltage of the GRID portion 118 is controlled to be constant, the charge voltage of the charger 117 varies according to the attachment state of toner to the wire of the charger 117 or the characteristics of the transistors TR1 and TR2. Accordingly, it is not always true that abnormality occurs in the charger 117 corresponding to the high-voltage power supply unit 110 which applies the largest voltage.

Therefore, the discharge detection program 96 does not determine that abnormality occurs in the charger 117 corresponding to the high-voltage power supply unit 110 which applies the largest voltage. Instead, the discharge detection program 96 operates the CPU 91 to sequentially decrease the duty value from the PWM control signal having a largest duty value to thereby decrease the application voltage, and on the basis of the detection state of the discharge detection circuit 130, to determine whether or not abnormality occurs in the charger 117.

Specifically, at Step 1 (hereinafter, referred to as "S1") of FIG. 5, the CPU 91 determines whether or not it is a timing to apply the charge voltage to the charger 117. The application timing is determined on the basis of whether or not the main control processing section (program) executes printing.

If it is determined that printing is not executed and it is not the application timing (S1: NO), the first to fourth chargers 117Y, 117M, 117C, and 117K are not discharged, and the program returns to S1. Meanwhile, if it is determined that printing is executed and it is the application timing (S1: YES), it is determined whether or not abnormal discharge is generated at S2.

When the discharge detection signal input port 91*a* is in the "H" by a discharge detection signal input from the discharge detection circuit 130, the CPU 91 determines that abnormal discharge is not generated in any one of the first to fourth chargers 117Y, 117M, 117C, and 117K (normal discharge) (S2: NO), and the program returns to S1.

When the discharge detection signal input port 91*a* is in the "L" by the discharge detection signal input from the discharge detection circuit 130, the CPU 91 determines that arc discharge (abnormal discharge) is generated in any one of the first to fourth chargers 117Y, 117M, 117C, and 117K (S2: YES), and at S3, performs a discharge detection processing. In the discharge detection processing, a charger 117 in which abnormality occurs is detected among the plurality of chargers 117Y, 117M, 117C, and 117K which are connected to the discharge detection circuit 130 in parallel.

Figure 6:
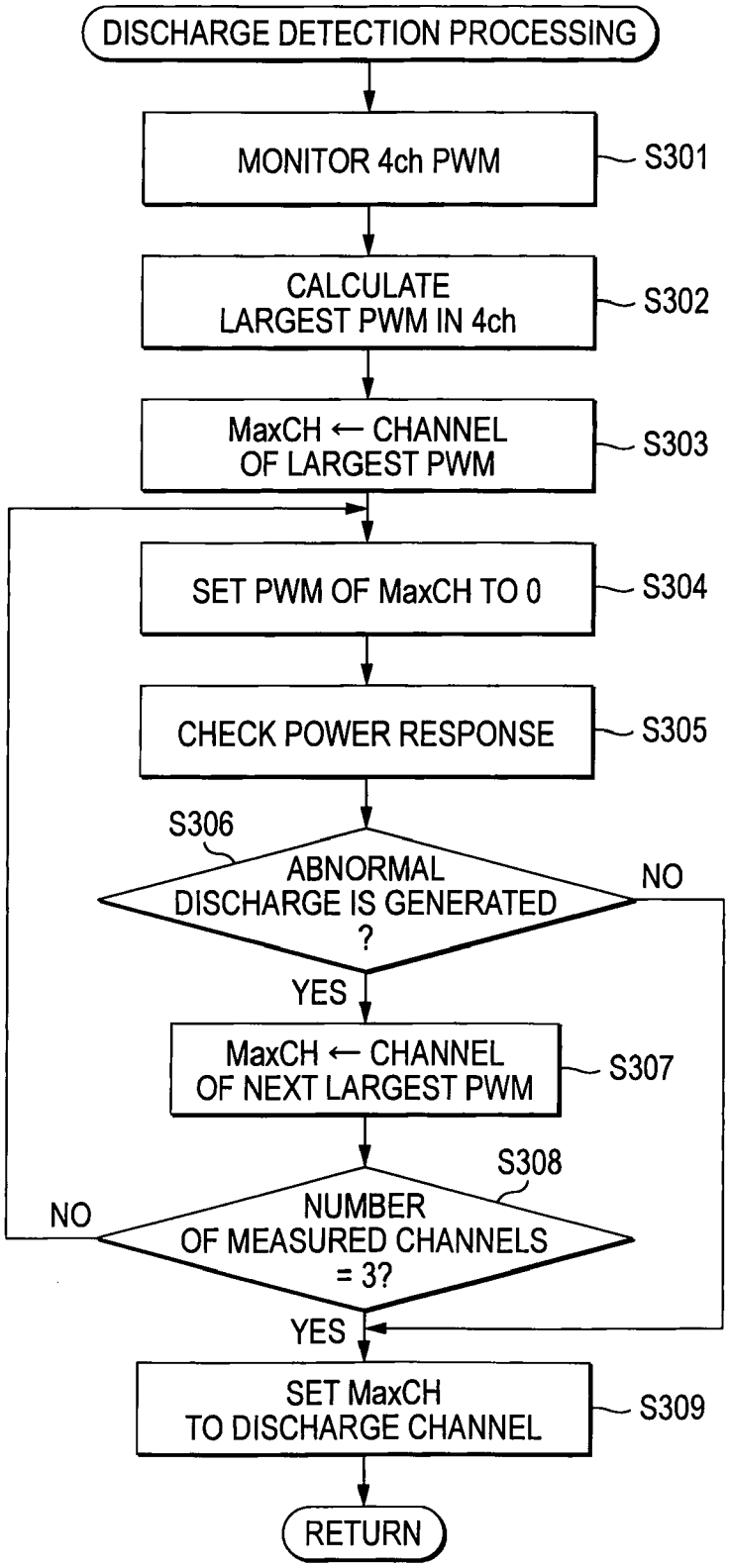
FIG. 6 is a sub-flowchart of a discharge detection processing shown in FIG. 5.

FIG. 6 is a sub-flowchart of the discharge detection processing shown in FIG. 5. In S301 of FIG. 6, the CPU 91 monitors the duty value of a four-channel (hereinafter, referred to as "4ch") PWM control signal for high-voltage power supply units 110Y, 110M, 110C and 110K, respectively. In this exemplary embodiment, theoretically, the duty value of the PWM control signal is proportional to the application voltage of the high-voltage power supply unit 110, and thus by monitoring the PWM control signal, the application voltage can be detected.

Next, in S302, a PWM control signal having a largest duty value among the 4ch PWM control signals is calculated. In this exemplary embodiment, theoretically, the duty value of the PWM control signal is proportional to the application voltage of the high-voltage power supply unit 110. Accordingly, for the PWM control signal having the largest duty value, the application voltage of the high-voltage power supply unit 110 is largest, and a charger 117 corresponding to that high-voltage power supply unit 110 is likely to generate arc discharge.

However, it is not always true that, since the duty value of the PWM control signal is largest, abnormality occurs in the charger 117 corresponding to the largest PWM control signal. For example, in the first to fourth chargers 117Y, 117M, 117C, and 117K, when a wire is exposed to the wind, the amount of silica in the toner component to be attached to the wire varies. A wire which is thickened due to the attached silica is likely to be discharged, and for the charger 117 including the wire, the application voltage of the high-voltage power supply unit 110 tends to be increased, as compared with a wire to which silica is not attached so much. Accordingly, in S303 to S309, the duty value of the PWM control signal is controlled to be 0, that is, the application voltage of the high-voltage power supply unit 110 is controlled to be 0 V. In this state, the detection state of the discharge detection circuit 130 is checked, and a charger 117 in which abnormality occurs is detected.

Specifically, first, in S303, a channel from which a PWM control signal having the largest duty value calculated in S302 is set to MaxCH. That is, one of the control information output ports 98*a*, 98*b*, 98*c*, and 98*d*, from which the PWM control signal having the largest duty value is output, is selected, and a charger 117 which is connected to that output port is set to MaxCH. Next, in S304, the duty value of the PWM control signal in MaxCH is set to 0. That is, with the PWM control signal, the application voltage of the high-voltage power supply unit 110 having the largest application voltage is controlled to be smaller.

Next, in S305, a power response of the high-voltage power supply unit 110 corresponding to MaxCH is checked. That is, when the duty value of the PWM control signal is set to 0, the high-voltage power supply unit 110 corresponding to MaxCH is put in an OFF state, and the application voltage is decreased and made stable. In this exemplary embodiment, it is assumed that a standby time required for the power response is 5 ms.

Subsequently, in S306, it is determined whether or not abnormal discharge is generated. If the duty value of the PWM control signal is controlled to be 0, the discharge detection signal input port 91*a* is switched to the "H". In this state, when abnormal discharge is not detected (S306: NO), it means that abnormality occurs in the charger 117 in which the duty value of the PWM control signal is controlled to be 0. In this case, in S309, the channel which is set to MaxCH is set to a discharge channel and stored in the RAM 93, and then the program returns to S3 of FIG. 5.

Meanwhile, even though the duty value of the PWM control signal is controlled to be 0, in a state where the discharge detection signal input port 91*a* is in the "L", when abnormal discharge is still detected (S306: YES), it means that no abnormality occurs in the charger 117 in which the duty value of the PWM control signal is controlled to be 0. Next, in S307, a charger 117 that outputs a PWM control signal having the next largest duty value to the high-voltage power supply unit 110 is set to MaxCH. That is, a charger 117 having the next largest application voltage is set to MaxCH.

Next, in S308, it is determined whether or not the number of measured channels is three. In the first exemplary embodiment, four chargers 117 are provided, and if abnormality is not detected in the three chargers 117, it can be determined that abnormality occurs in the remaining charger 117. Therefore, in the first exemplary embodiment, three (N−1) which is less by one than four (N), which is the total number of chargers 117 connected to the discharge detection circuit 130, is set to a reference value of the number of measured channels.

When the number of measured channels is not three, the program returns to S304. Next, similarly to the process of S304 and later, the duty value of a PWM control signal having the next largest duty value is controlled to be 0, and on the basis of the detection state of the discharge detection circuit 130, it is determined whether or not abnormality occurs in the charger 117 which is set to MaxCH. It is noted that if the duty value of a PWM control signal having the next largest duty value is controlled to be 0, the duty value of the PWM control signal having the largest duty value may be returned to original state or may be maintained to be 0.

Even though S304 to S308 are repeatedly performed, and for the three (N−1) chargers 117, the duty value of the PWM control signal is set to 0, that is, for the three (N−1) chargers 117, the application voltage of the high-voltage power supply unit 110 is controlled to be smaller, in a state where the discharge detection signal input port 91*a* is in the "L", the discharge detection circuit 130 may not detect abnormality in the chargers 117 (S04, S305, S306: NO). In this case, in S307, the fourth charger 117 is set to MaxCH. That is, when no abnormality occurs in the three chargers 117, the last charger 117 in which the PWM control signal has the smallest duty value is set to MaxCH.

At a point of time at which the fourth charger 117 is set to MaxCH, the number of measured channels is 3 (S308: YES), and the program proceeds to S309. In S309, the fourth charger 117 is set to a discharge channel. That is, for the fourth charger 117, it is not necessary to control the duty value of the PWM control signal to be 0, to thereby determine presence/absence abnormality, and it is determined that abnormality occurs in the fourth charger 117. Thereafter, the program returns to S3 of FIG. 5.

Subsequently, in S4 of FIG. 5, for the charger 117 which is set to the discharge channel, a discharge error notification processing is performed. In the discharge error notification processing, a user is notified of the charger 117, in which abnormality occurs, determined by the discharge detection processing shown in FIG. 6, in which abnormality occurs is notified to a user. In this exemplary embodiment, a charger 117 in which abnormality occurs is displayed on the display unit 19 provided in the printer 1. The discharge error notification may be performed by sound from a speaker provided in the printer 1 or buzzer sound, or may be performed by vibration, such as a vibrator. In addition, the discharge error notification may be performed by displaying the charger 117, in which abnormality occurs, on a personal computer, which transmits print data.

Next, in S5, printing is stopped. This is because, even though printing is continued, a satisfactory printing result may not be obtained, for example, the printed surface may be blackened. Next, in S6, on the basis of the detection signal of the open/close sensor 13, it is determined whether or not the user opens the cover 5*b*. When the user does not open the cover 5*b* (S6: NO), since abnormal discharge is likely to be generated again, the program stands by as it is without cleaning the charger 117, in which abnormality occurs.

Meanwhile, when the user opens the cover 5*b* (S6: YES), in S7, it is determined whether or not the user closes the cover 5*b*. When the user does not close the cover 5*b* (S7: NO), the program stands by as it is. When the user closes the cover 5*b* (S7: YES), it means that cleaning of the charger 117 in which abnormality occurs is completed, and the program returns to S1 and performs the discharge detection.

<Specific Example>

The PWM control signal has a larger duty value in a descending order of the fourth charger 117K, the first charger 117Y, the second charger 117M, and the third charger 117C.

When the discharge detection signal input port 91*a* is put in the "L" according to the discharge detection signal output from the discharge detection circuit 130, first, for the fourth charger 117K in which the PWM control signal has the largest duty value, the duty value of the PWM control signal is controlled to be 0. Subsequently, it is determined whether the discharge detection signal input port 91*a* is in the "H" or in the "L" by the discharge detection signal output from the discharge detection circuit 130 (see S1, S2: YES, S3 in FIG. 5, S301 to S306 in FIG. 6).

By controlling the duty value of the PWM control signal output to the fourth charger 117K to be 0, when the discharge detection signal input port 91*a* is put in the "H", it is determined that abnormality occurs in the fourth charger 117K, and the fourth charger 117K is set to the discharge channel (see S306: NO and S309 in FIG. 6).

In this case, a message indicating that abnormality occurs in the fourth charger 117K is displayed on the display unit 19, and printing is stopped. Next, the user views the display unit 19, opens the cover 5*b*, cleans the fourth charger 117K, and closes the cover 5*b*. Thereafter, the discharge detection is performed again (see S4, S5, S6: YES, S7: YES in FIG. 5).

Meanwhile, even though the duty value of the PWM control signal output to the fourth charger 117K is controlled to be 0, when the discharge detection signal input port 91*a* is in the "L", for the first charger 117Y in which the PWM control signal has the next largest duty value, which is less than that in the fourth charger 117K, the duty value of the PWM control signal is controlled to be 0. Thereafter, it is determined whether the discharge detection signal input port 91*a* is in the "H" or in the "L" (see S306: YES, S307, S308: NO, S304, S305, S306 in FIG. 6).

By controlling the duty value of the PWM control signal in the first charger 117Y to be 0, when the discharge detection signal input port 91*a* is put in the "H", it is determined that abnormality occurs in the first charger 117Y, and the first charger 117Y is set to the discharge channel (see S306: YES, S309 in FIG. 6). The process of S4 and later in FIG. 5 is the same as the process when it is determined that abnormality occurs in the fourth charger 117K, and thus the description thereof will be omitted.

Meanwhile, even though the duty value of the PWM control signal in the first charger 117Y is controlled to be 0, when the discharge detection signal input port 91*a* is in the "L", it is determined that no abnormality occurs in the first charger 117Y. In this case, for the second charger 117M in which the PWM control signal has the next largest duty value, which is less than that in the first charger 117Y, the duty value of the PWM control signal is controlled to be 0. Thereafter, it is determined on the basis of the detection state of the discharge detection circuit 130 whether or not abnormality occurs in the second charger 117M (see S306: YES, S307, S308: NO, S304, S305, S306 in FIG. 6).

When it is also determined that no abnormality occurs in the second charger 117M, the third charger 117C is set to MaxCH. At this point of time, since the number of measured channels is three, it is not necessary to control the duty value of the PWM control signal in the third charger 117C to be 0 and to determine presence/absence of abnormality on the basis of the discharge detection signal. Therefore, the third charger 117C is set to the discharge channel (see S306: YES, S307, S308: NO, S304, S305, S306: YES, S307, S308: YES, S309 in FIG. 6).

The process after discharge channel setting is the same as the process when it is determined that abnormality occurs in the fourth charger 117K, and thus the description thereof will be omitted (see S4 to S7 in FIG. 5).

<Advantage of Printer According to First Exemplary Embodiment>

As described above, in the printer 1 according to the first exemplary embodiment, the application voltage of the high-voltage power supply unit 110 having the largest application voltage, that is, the application voltage of the high-voltage power supply unit 110 in which abnormality is likely to occur is controlled to be smaller (see S301 to S304 in FIG. 6). By controlling the application voltage to be smaller, when the discharge detection circuit 130 does not detect abnormality, it is determined that abnormality occurs in the charger 117 corresponding to the high-voltage power supply unit 110 whose application voltage is controlled (see S306: NO, S309 in FIG. 6). Meanwhile, even though the application voltage is controlled to be smaller, when the discharge detection circuit 130 detects abnormality, it is determined that no abnormality occurs in the charger 117 corresponding to the high-voltage power supply unit 110 whose application voltage is controlled (see S306: YES in FIG. 6).

In this way, in the printer 1 according to the first exemplary embodiment, abnormality detection is preferentially performed on a charger 117 in which abnormality is likely to occur. Therefore, a charger 117, in which abnormality occurs, among the four chargers 117Y, 117M, 117C, and 117K can be detected in a short time.

In the printer 1 according to the first exemplary embodiment, when no abnormality occurs in the charger 117 having the largest application voltage, for the high-voltage power supply unit 110 having the next largest application voltage, that is, the high-voltage power supply unit 110 in which abnormality is next most likely to occur, the application voltage is controlled to be smaller (see S306: YES, S307 in FIG. 6). Accordingly, in the printer 1 according to the first exemplary embodiment, presence/absence of abnormality is determined sequentially from a charger 117 in which abnormality is likely to occur. As a result, abnormality in the first to fourth chargers 117Y, 117M, 117C, and 117K can be efficiently determined.

In the printer 1 according to the first exemplary embodiment, the application voltage of each of the high-voltage power supply units 110Y, 110M, 110C, and 110K is detected on the basis of the PWM control signal (control information) output from each of the control information output ports 98*a*, 98*b*, 98*c*, and 98*d* to each of the high-voltage power supply unit 110Y, 110M, 110C, and 110K to control the application voltage of the high-voltage power supply unit 110Y, 110M, 110C, and 110K (see S301 in FIG. 6). Therefore, it is not necessary to provide an electronic circuit which measures the application voltage of each of the high-voltage power supply units 110Y, 110M, 110C, and 110K, and as a result, the circuit configuration can be simplified.

In the printer 1 according to the first exemplary embodiment, when it is determined whether or not abnormality occur in the first to fourth chargers 117Y, 117M, 117C, and 117K, even if the application voltage is controlled to be smaller for the high-voltage power supply units 110 corresponding to the three chargers 117, when the discharge detection circuit 130 detects abnormality, it is determined that abnormality occur in the remaining fourth charger 117 (see S308: YES, S309 in FIG. 6). Therefore, with the printer 1 of the first exemplary embodiment, the number of determinations of abnormality in the chargers 117 can be reduced smaller than the number (4) of chargers 117, and as a result, the abnormality detection time can be reduced.

In the printer 1 according to the first exemplary embodiment, the user can be notified of the charger 117 in which abnormality occurs by displaying the charger 117 on the display unit 19 (see S4 in FIG. 5). Therefore, it is possible to make the user to clean the charger 117 in which abnormality occurs.

Second Exemplary Embodiment

Figure 7:
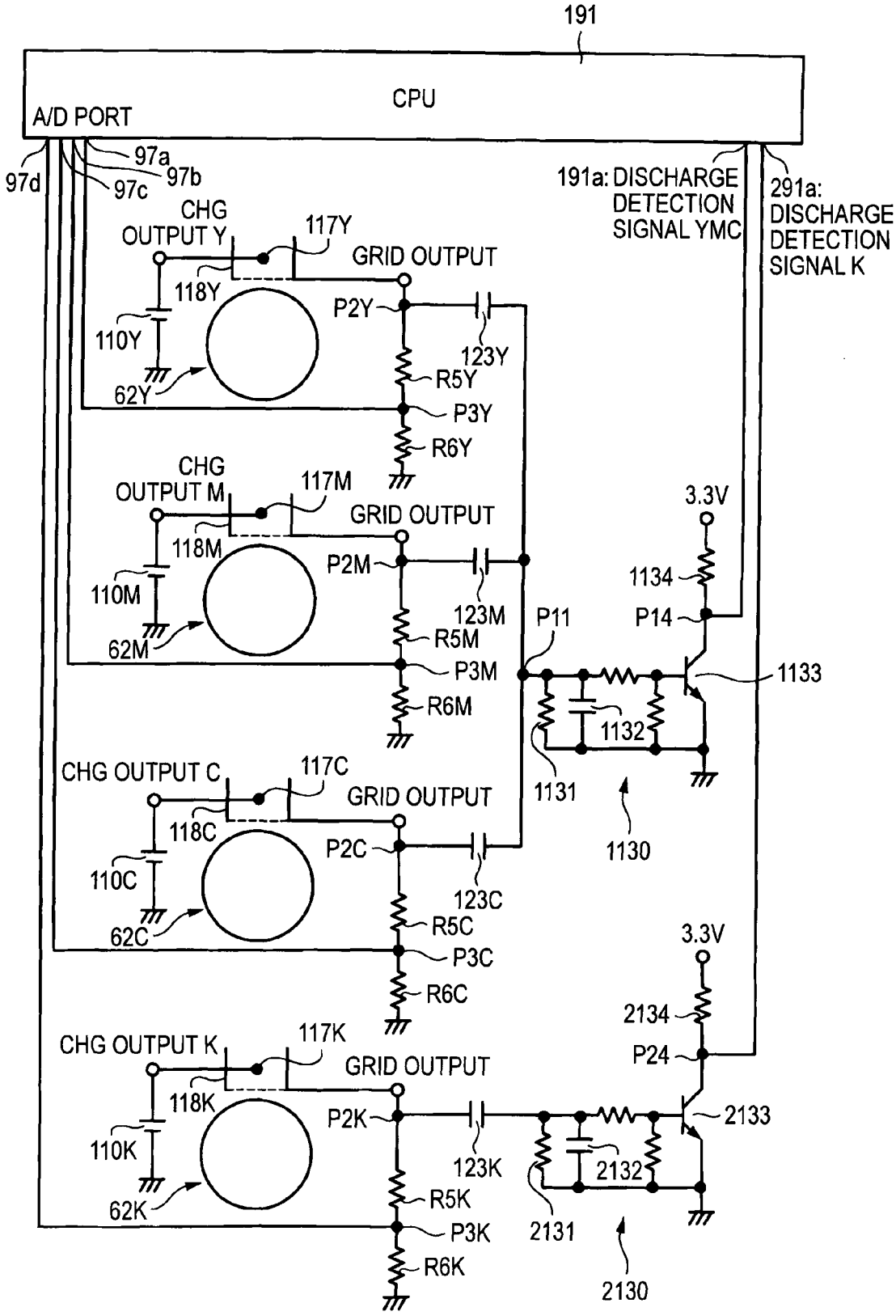
FIG. 7 is a diagram illustrating first and second discharge detection circuits that are used in a color electrophotographic printer according to a second exemplary embodiment of the present invention.

Next, a second exemplary embodiment of an image forming apparatus according to the present invention will be described with reference to the drawings. FIG. 7 is a diagram illustrating first and second discharge detection circuits 1130 and 2130 that are used in a printer 1A according to the second exemplary embodiment of the invention. Similar to the first exemplary embodiment, a printer 1A as an example of an image forming apparatus is a color electrophotographic printer.

The printer 1A includes a first discharge detection circuit 1130, and a second discharge detection circuit 2130. The printer 1A is different from the printer 1 of the first exemplary embodiment in that, when the first discharge detection circuit 1130 detects discharge, the application voltage of the high-voltage power supply unit 110 is controlled to be smaller, to thereby determine abnormality in the chargers 117. Here, the difference from the first exemplary embodiment will be described, and the overlap description will be appropriately omitted. Moreover, in the description and the drawings, the same elements as those in the first exemplary embodiment are represented by the same reference numerals.

<Discharge Detection Circuit>

In the printer 1A according to the second exemplary embodiment, the first discharge detection circuit 1130 is connected to a first discharge detection signal input port 191*a* of a CPU 191, and a second discharge detection circuit 2130 is connected to a second discharge detection signal input port 291*a* of the CPU 191.

First to third chargers 117Y, 117M, and 117C are primarily used for only color printing, and a fourth charger 117K is primarily used for both color printing and monochrome printing. Accordingly, the first to third chargers 117Y, 117M, and 117C are contaminated to the same extent, but the fourth charger 117K is more frequently used than the first to third chargers 117K, 117M, and 117C and more easily contaminated. Therefore, in the printer 1A of the second exemplary embodiment, the first and second discharge detection circuits 1130 and 2130 are provided in order to detect abnormality in the first to fourth chargers 117K, 117M, 117C, and 117K in two systems.

To the first discharge detection circuit 1130, the first charger 117Y, the second charger 117M, and the third charger 117C are connected in parallel. The first discharge detection circuit 1130 is commonly used to detect abnormality in the first to third chargers 117Y, 117M, and 117C. The first discharge detection circuit 1130 includes a resistor 1131, a capacitor 1132, a transistor 1133, and a resistor 1134. The first discharge detection circuit 1130 has the same function as that of the discharge detection circuit 130 in the first exemplary embodiment.

To the second discharge detection circuit 2130, only the fourth charger 117K is connected. The second discharge detection circuit 2130 specially detects abnormality in the fourth charger 117K. The second discharge detection circuit 2130 includes a resistor 2131, a capacitor 2132, a transistor 2133, and a resistor 2134. The second discharge detection circuit has the same function as that of the discharge detection circuit 130 in the first exemplary embodiment.

The CPU 191 has a first input port 191*a* that is connected to the first discharge detection circuit 1130 through a connection point P14, and a second input port 291*a* that is connected to the second discharge detection circuit 2130 through a connection point P24. The first input port 191*a* and the second input port 291*a* detect the voltages of the connection points P14 and P24, respectively, to thereby detect abnormality in the first to fourth chargers 117Y, 117M, 117C, and 117K.

Figure 8:
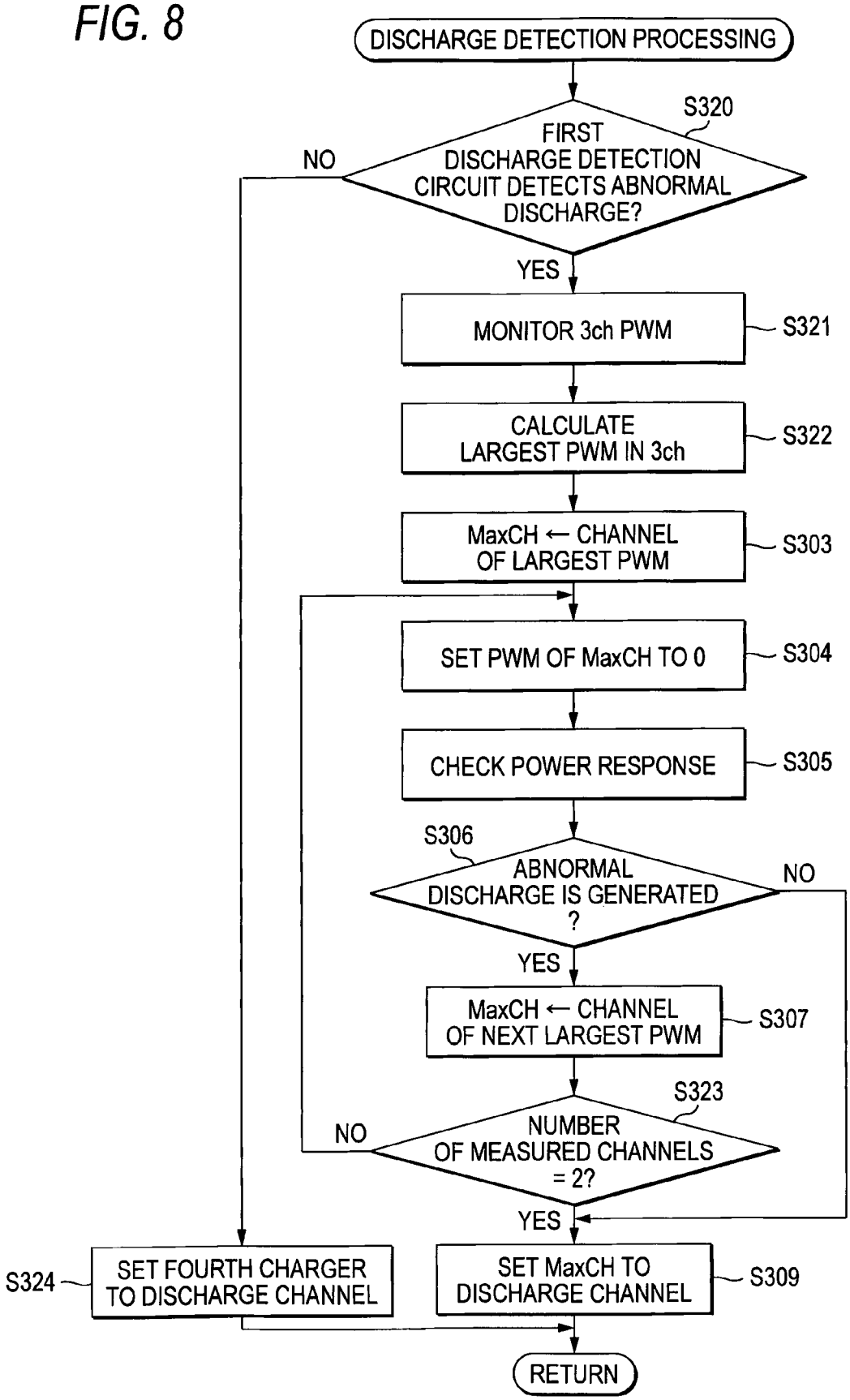
FIG. 8 is a diagram illustrating a processing procedure of a discharge detection program that is executed by the color electrophotographic printer including the first and second discharge detection circuits shown in FIG. 7.

The CPU 191 executes a discharge detection program 96A including a discharge detection processing shown in FIG. 8, to thereby detect a charger 117 in which abnormality occurs. FIG. 8 is a diagram illustrating a processing procedure of a discharge detection processing that is executed by the printer 1A including the first and second discharge detection circuits 1130 and 2130 shown in FIG. 7.

The discharge detection program 96A is the same as the discharge detection program 96 of the first exemplary embodiment, except for the discharge detection processing shown in FIG. 8. In the discharge detection processing shown in FIG. 8, when the first discharge detection circuit 1130 detects discharge, the duty value of a PWM control signal output to each of the first to third chargers 117Y, 117M, and 117C is controlled to be 0, and on the basis of discharge detection signals Y, M, and C of the first discharge detection circuit 1130, it is determined whether or not abnormality occurs. Meanwhile, when the second discharge detection circuit 2130 detects discharge, it is determined that abnormality occurs in the fourth charger 117K, without controlling the duty value of the PWM control signal to be 0 to thereby determine abnormality.

Specifically, in S320 of FIG. 8, the first discharge detection circuit 1130 is put in the "L", and the CPU 191 determines whether or not abnormal discharge is detected. When the second discharge detection signal input port 291*a* is put in the "L" by the discharge detection signal K, the CPU 191 determines that the first discharge detection circuit 1130 does not detect discharge (S320: NO), and in S324, sets the fourth charger 117K to the discharge channel. Thereafter, the program proceeds to S4 of the main flowchart shown in FIG. 5. The process of S4 and later in FIG. 5 is the same as the process in the first exemplary embodiment, and thus the description thereof will be omitted.

Meanwhile, when the first discharge detection signal input port 191*a* is put in the "L" by the discharge detection signals Y, M, and C, the CPU 191 determines that the first discharge detection circuit 1130 detects discharge (S320: YES). Next, in S321, the CPU 191 monitors the duty values of the PWM control signals output from control signal output ports 98*a*, 98*b*, and 98*c* to the first to third chargers 117Y, 117M, and 117C (3ch). Next, in S322, a PWM control signal having the largest duty value among the 3ch PWM control signals is calculated. The process of S303 to S307 is the same as the process in the first exemplary embodiment, and thus the description thereof will be omitted.

In S323, the CPU 191 determines whether or not the number of measured channels is two. The reason why a reference value for the number of measured channels is two is that the number of the first to third chargers 117Y, 117M, and 117C for which the first discharge detection circuit 1130 detects discharge is three. When the number of measured channels is not two (S323: NO), the program returns to S304. Next, for a channel of a PWM control signal having the next larges duty value, the duty value of the PWM control signal is controlled to be 0. Thereafter, it is determined whether or not abnormality occurs in a charger 117 corresponding to the high-voltage power supply unit 110 in which the PWM control signal is controlled.

Meanwhile, when the first discharge detection circuit 1130 does not detect abnormality for two chargers 117 among the three chargers 117Y, 117M, and 117C (S306: NO), in S307, the remaining third charger 117 is set to the MaxCH. At this time, since the number of measured channels is two (S323: YES), it is determined that abnormality occurs in the third charger 117, without controlling the duty value of the PWM control signal in the third charger 117 to be 0 to thereby determine presence/absence of abnormality. Next, in S309, the third charger 117 is set to the discharge channel, and then the program returns to S3 in FIG. 5.

<Specific Example>

For example, when the second discharge detection signal input port 291*a* is in the "L", the second discharge detection circuit 2130 detects abnormality. In this case, it is determined that abnormality occurs in the fourth charger 117K, without controlling the duty value of the PWM control signal to be 0 for the first to third chargers 117Y, 117M, and 117C (see S320: NO, S324 in FIG. 8).

Meanwhile, for example, when the first detection signal input port 191*a* is put in the "L" by the discharge detection signals Y, M, and C, the first discharge detection circuit 1130 detects discharge in any one of the first to third chargers 117Y, 117M, and 117C (see S320: YES in FIG. 8).

For example, it is assumed that the duty value of the PWM control signal becomes larger in a descending order of the first charger 117Y, the second charger 117M, and the third charger 117C. In this case, first, the duty value of the PWM control signal in the first charger 117Y is controlled to be 0, and on the basis of the discharge detection signals Y, M, and C output from the first discharge detection circuit 1130 to the first discharge detection signal input port 191*a*, abnormality is determined. In a state where the first discharge detection signal input port 191*a* is put in the "H" by the discharge detection signals Y, M, and C output from the first discharge detection circuit 1130, if the voltage applied from the high-voltage power supply unit 110Y to the first charger 117Y is controlled to be smaller, the first discharge detection circuit 1130 does not detect discharge. Accordingly, it is determined that abnormality occurs in the first charger 117Y. Next, the first charger 117Y is set to the discharge channel (see S321, S322, S303, S304, S305, S306: NO, S309 in FIG. 8).

Meanwhile, when it is determined that no abnormality occurs in the first and second chargers 117Y and 117M, it is determined that abnormality occurs in the third charger 117C, without controlling the duty value of the PWM control signal output to the third charger 117C to be 0 to thereby determine whether or not abnormality occurs in the third charger 117C (see S323: YES, S309 in FIG. 8). Thereafter, the program proceeds to S3 of FIG. 5.

<Advantage of the Printer According to the Second Exemplary Embodiment>

As described above, the printer 1A according to the second exemplary embodiment has the following advantages, in addition to the advantages in the printer 1 according to the first exemplary embodiment.

When the first discharge detection circuit 1130 detects abnormality, for a high-voltage power supply unit 110 having the largest application voltage among the high-voltage power supply units 110Y, 110M, and 110C corresponding to the first to third chargers 117Y, 117M, and 117C, the application voltage is controlled to be smaller. Thereafter, on the basis of the detection state of the first discharge detection circuit 1130, it is determined whether or not abnormality occurs in a charger 117 corresponding to the high-voltage power supply unit 110 in which the application voltage is controlled (see S320: YES, S321, S322, S303, S304, S305, and S306: YES in FIG. 8).

Meanwhile, when the second discharge detection circuit 2130 detects abnormality, and the first discharge detection circuit 1130 does not abnormality, for the high-voltage power supply unit 110K corresponding to the fourth charger 117K, it is not necessary to control the application voltage. In this case, it is just determined that abnormality occurs in the fourth charger 117K connected to the second discharge detection circuit 2130 (see S320: NO, S324 in FIG. 8).

With the printer 1A of the second exemplary embodiment, the number of detections of abnormality while controlling the application voltage to be smaller can be reduced smaller than that in the printer 1 of the first exemplary embodiment, and as a result, the abnormality detection time can be reduced shorter than that in the printer 1 of the first exemplary embodiment.

While the present invention has been shown and described with reference to certain exemplary embodiments thereof, it will be understood by those skilled in the art that various changes in form and details may be made therein without departing from the spirit and scope of the invention as defined by the appended claims.

(1) For example, although the printer 1 is used as the image forming apparatus in the foregoing exemplary embodiments, a multi function device, a facsimile machine, a copy machine, or the like may be used as the image forming apparatus.

(2) For example, although a case where the printer 1 has four chargers 117Y, 117M, 117C, and 117K for yellow (Y), magenta (M), cyan (C), and black (K) in the foregoing exemplary embodiments, the number of chargers 117 is not limited thereto but may be more than four or less than four. In addition, color combination of yellow (Y), magenta (M), cyan (C), and black (K) may be changed.

(3) Although abnormal discharge detection is performed on the charger 117 in the foregoing exemplary embodiments, discharge state detection may also be performed on the static eliminator 33 and a static eliminator 33 in which abnormal discharge is generated may be specified by means of the discharge detection circuit 130, 1130, or 2130 and the discharge detection program 96 or 96A which are similar to those used for abnormal discharge detection on the charger 117.

(4) For example, in the foregoing exemplary embodiments, in the discharge detection processing (S3) of FIG. 5, in order to suppress useless printing, the duty value of the PWM control signal of MaxCH is set to 0 (see S304 in FIG. 6). Alternatively, if the photosensitive member 62 is rotated while the charge voltage is not applied from the charger 117 to the photosensitive member 62, the photosensitive member 62 may be contaminated by toner. In this case, the duty value of the PWM control signal may be controlled to be smaller, for example, half or a predetermined value, such that a weak charge voltage may be applied from the charger 117 to the photosensitive member 62.

(5) For example, in the foregoing exemplary embodiments, the chargers 117 and the high-voltage power supply units 110 are provided one-to-one. Alternatively, a high-voltage power supply unit 110 may be commonly used for the chargers 117Y and 117M, and a high-voltage power supply unit 110 may be commonly used for the chargers 110C and 110K. If so, the number of high-voltage power supply units 110 can be reduced and thus costs can be reduced. In this case, a charger 117 in which abnormality occurs cannot be specified, but it can be detected which high-voltage power supply unit 110 a charger 117, in which abnormality occurs, belongs to. With this configuration, since the number of discharge detections can be reduced, a charger 117 which is suspected of abnormality can be detected in a short time. In addition, if the charger 117 which is suspected of abnormality is displayed on the display unit 19, the user can simply perform an abnormality resolution processing in a short time. This is particularly advantageous when a large number of chargers 117 are provided.

(6) For example, in the foregoing exemplary embodiments, the duty value of the PWM control signal is proportional to the application value, and presence/absence of abnormality is determined sequentially from a charger 117 in which the PWM control signal having a larger duty value (see S302, S303 in FIG. 6, S322, S303 in FIG. 8). Alternatively, when the duty value of the PWM control signal is inversely proportional to the application voltage, presence/absence of abnormality may be determined sequentially from a charger 117 in which the PWM control signal has a smaller duty value.

What is claimed is:

1. An image forming apparatus comprising:

a plurality of photosensitive members;

a plurality of discharging units respectively facing the plurality of photosensitive members;

a plurality of high-voltage power supply units which are provided for a plurality of charging units and supply power to the plurality of discharging units;

a discharge detection unit that detects abnormality in the plurality of discharging units while the plurality of high-voltage power supply units is supplying power to the plurality of discharging units, respectively;

a controller which controls the output of one of the high-voltage power supply units having the largest output to be smaller when the discharge detection unit detects abnormality; and a determination unit which, in a state where the controller controls the output of the one of the high-voltage power supply units, determines whether abnormality occurs in the discharging unit corresponding to the one of the high-voltage power supply units based on the detection state of the discharge detection unit.

2. The image forming apparatus according to claim 1, wherein, if the determination unit determines that no abnormality occurs in the discharging unit corresponding to the one of the high-voltage power supply units, the output of which is controlled to be smaller, the controller controls the output of another one of the high-voltage power supply units having the next largest output to be smaller.

3. The image forming apparatus according to claim 1, wherein the controller detects the values of the outputs of the high-voltage power supply units based on control information for controlling the high-voltage power supply units.

4. The image forming apparatus according to claim 1, wherein the number of the discharging units is N, wherein, if the controller controls the outputs of the high-voltage power supply units corresponding to a first to (N−1)-th discharging units to be smaller and the discharge detection unit does not detect abnormality in the first to (N−1)-th discharging units, the determination unit determines that abnormality occurs in the N-th discharging unit without controlling the output of the N-th high-voltage power supply unit.

5. The image forming apparatus according to claim 1, wherein the plurality of high-voltage power supply units is provided correspondingly to the plurality of discharging units.

6. The image forming apparatus according to claim 1, wherein the plurality of photosensitive members includes:

a first photosensitive member for a yellow developer;

a second photosensitive member for a magenta developer;

a third photosensitive member for a cyan developer; and a fourth photosensitive member for a black developer, wherein the plurality of discharging units includes:

a first discharging unit facing the first photosensitive member;

a second discharging unit facing the second photosensitive member;

a third discharging unit facing the third photosensitive member; and a fourth discharging unit facing the fourth photosensitive member;

wherein the discharge detection unit includes:

a first discharge detection unit which is connected to the first discharging unit, the second discharging unit, and the third discharging unit in parallel, and a second discharge detection unit which is connected to the fourth discharging unit, wherein the controller controls the output of the high-voltage power supply unit having the largest output to be smaller when the first discharge detection unit detects abnormality, and the determination unit determines, based on the detection state of the first discharge detection unit, whether or not abnormality occurs in the discharging unit corresponding to the high-voltage power supply unit, the output of which is controlled to be smaller.

7. The image forming apparatus according to claim 1, further comprising:

a notification unit that provides a notification of a determination result generated by the determination unit.

8. The image forming apparatus according to claim 1, wherein each of the discharging units comprises a charger which charges a respective one of the photosensitive members.

9. The image forming apparatus according to claim 1, wherein each of the discharging units comprises a static eliminator which generates corona discharge.

10. An abnormal discharge detection device comprising:

a plurality of discharging units;

a plurality of power supply units which applies voltage to the plurality of discharging units;

a discharge detection unit which detects abnormality occurring in any one of the plurality of discharging units;

a voltage detection unit which detects application voltages of the plurality of power supply units;

a controller configured to control the application voltages of the plurality of power supply units;

a determination unit which determines in which one of the discharging units the abnormality occurs in the order of the values of the detected application voltages by controlling the application voltage of the plurality power supply units in an order from high to low.

11. The abnormal discharge detection device according to claim 10, wherein each of the plurality of discharge units comprises a charger.

12. The abnormal discharge detection device according to claim 10, wherein each of the plurality of discharge units comprises a static eliminator.

13. The abnormal discharge detection device according to claim 10, wherein the voltage detection unit detects the application voltages of the plurality of power supply units in response to detecting the abnormality in the discharge detection unit.

14. The abnormal discharge detection device according to claim 10, further comprising an indication unit which indicates the discharging unit in which the abnormality occurs as determined by the determination unit.

15. The image forming apparatus according to claim 1, wherein the charging units are connected to the discharge detection unit in parallel.

16. The image forming apparatus according to claim 1, further comprising:

a highest voltage determination unit which determines which one of the high-voltage power supply units has the largest output, and wherein the controller controls the output of the one of the high-voltage power supply units determined to have the highest voltage by the highest voltage determination unit.

* * * * *